US009096292B2

(12) United States Patent
Rohden et al.

(10) Patent No.: US 9,096,292 B2
(45) Date of Patent: Aug. 4, 2015

(54) SHIP COMPRISING FASTENING MEANS ARRANGED IN A GRID OVER THE CARGO AREA

(75) Inventors: Rolf Rohden, Aurich (DE); Harald Albrechts, Moorhusen (DE)

(73) Assignee: Wobben Properties GmbH, Aurich (DE)

( * ) Notice: Subject to any disclaimer, the term of this patent is extended or adjusted under 35 U.S.C. 154(b) by 212 days.

(21) Appl. No.: 13/823,073

(22) PCT Filed: Sep. 8, 2011

(86) PCT No.: PCT/EP2011/065524

§ 371 (c)(1),
(2), (4) Date: May 24, 2013

(87) PCT Pub. No.: WO2012/034918

PCT Pub. Date: Mar. 22, 2012

(65) Prior Publication Data

US 2013/0233227 A1 Sep. 12, 2013

(30) Foreign Application Priority Data

Sep. 16, 2010 (DE) ..... 10 2010 040 902

(51) Int. Cl.
*B63B 25/00* (2006.01)
*F16B 17/00* (2006.01)

(52) U.S. Cl.
CPC ..... *B63B 25/00* (2013.01); *B63B 25/002* (2013.01); *F16B 17/00* (2013.01); *Y10T 403/70* (2015.01)

(58) Field of Classification Search
CPC ..... B63B 25/004; B63B 25/18; B63B 25/00; F16B 17/00
USPC ..... 114/72, 73
See application file for complete search history.

(56) References Cited

U.S. PATENT DOCUMENTS

| | | | | | |
|---|---|---|---|---|---|
| 3,083,670 | A | * | 4/1963 | Harlander et al. | 410/85 |
| 3,327,654 | A | * | 6/1967 | Duncan et al. | 108/53.1 |
| 3,412,876 | A | * | 11/1968 | Caiabrese | 414/141.5 |
| 3,422,971 | A | * | 1/1969 | Wright | 414/143.2 |
| 3,434,445 | A | * | 3/1969 | Crumley | 114/72 |
| 3,680,518 | A | | 8/1972 | Tabuchi et al. | |
| 3,750,599 | A | | 8/1973 | Tayama | |
| 3,759,209 | A | * | 9/1973 | Iarossi et al. | 114/74 A |
| 3,776,169 | A | * | 12/1973 | Strecker | 410/77 |
| 3,817,412 | A | * | 6/1974 | Mercier et al. | 414/800 |
| 3,860,209 | A | * | 1/1975 | Strecker | 410/116 |
| 4,088,232 | A | * | 5/1978 | Lilly | 414/282 |

(Continued)

FOREIGN PATENT DOCUMENTS

| | | |
|---|---|---|
| DE | 254 711 A1 | 3/1988 |
| DE | 195 32 107 A1 | 3/1997 |

(Continued)

*Primary Examiner* — Lars A Olson
*Assistant Examiner* — Jovon Hayes
(74) *Attorney, Agent, or Firm* — Seed IP Law Group PLLC

(57) ABSTRACT

The invention concerns a ship, in particular a cargo ship, having a load surface for receiving load items, in particular piece goods. The invention concerns in particular a ship whose load surface has a plurality of receiving means which can be connected to fixing means and which are distributed in a grid over the load surface. The invention further concerns a floor element for a ship, in particular a cargo ship, and a securing element.

21 Claims, 11 Drawing Sheets

(56) References Cited

U.S. PATENT DOCUMENTS

| | | | | | |
|---|---|---|---|---|---|
| 4,130,075 | A | * | 12/1978 | Larive | 114/85 |
| 4,655,153 | A | * | 4/1987 | Bel | 114/75 |
| 4,715,308 | A | * | 12/1987 | Denison et al. | 114/72 |
| 4,890,565 | A | * | 1/1990 | Kelly et al. | 114/72 |
| 5,899,161 | A | * | 5/1999 | Sell et al. | 114/72 |
| 6,003,459 | A | * | 12/1999 | Nielsen | 114/72 |
| 6,223,669 | B1 | * | 5/2001 | Bowden | 114/65 R |
| 8,408,863 | B1 | * | 4/2013 | Benedict et al. | 414/803 |
| 2002/0009346 | A1 | * | 1/2002 | Holt et al. | 410/94 |
| 2010/0102015 | A1 | * | 4/2010 | Benneche | 211/183 |
| 2013/0233227 | A1 | * | 9/2013 | Rohden et al. | 114/72 |

FOREIGN PATENT DOCUMENTS

| | | | |
|---|---|---|---|
| DE | 10 2005 028 447 | A1 | 12/2006 |
| EP | 0 205 653 | A1 | 12/1986 |
| FR | 2 546 845 | A1 | 12/1984 |
| JP | 47-32350 | | 8/1972 |
| JP | 47-37428 | U | 12/1972 |
| JP | 50-123087 | U | 10/1975 |
| JP | 60-119693 | U | 8/1985 |
| JP | 9-507187 | A1 | 7/1995 |
| JP | 2006-27299 | A | 2/2006 |
| WO | 95/18037 | A1 | 7/1995 |

* cited by examiner

SHIP COMPRISING FASTENING MEANS ARRANGED IN A GRID OVER THE CARGO AREA

BACKGROUND

1. Technical Field

The present invention concerns a ship, in particular a cargo ship having a load surface for receiving load items, in particular piece goods. The invention further concerns a floor element for such a ship.

2. Description of the Related Art

Ships of the above-indicated kind are preferably used to transport piece goods of the most widely varying kinds over long distances. A typical situation of use in that respect is transporting wind power installations and wind power installation components and accessories for same from a production location to a destination location or a destination port.

Ships of the kind set forth in the opening part of this specification are usually designed to sail on the high seas. Because of recurring weather conditions such as a heavy sea, storms or because of vibration occurring in operation of the ship, it is necessary for the load which is carried on board to be reliably secured on the load surface of the ship.

Known ships make it possible to fix individually different piece goods on the load surface either only unsatisfactorily or with the involvement of unsatisfactory expenditure both in terms of time and also costs.

As state of the art attention is generally directed at this juncture to the following publication: EP 205 653 A1.

BRIEF SUMMARY

One embodiment of the present invention is directed to a ship having a load surface that has a plurality of receiving means which can be connected to fixing means and which are distributed in a grid over the load surface. In that respect the invention makes use of the realization that the plurality of receiving means on the load surface are preferably distributed over the entire load surface of the ship and are thus available at any time for fixing items on the load surface. The fact that a plurality of receiving means are arranged over the entire load surface means that a sufficient number of receiving means for connection to fixing means are available at any location on the load surface for the crew who have to stow the load on board the ship in order to be able to determine an ideal storage position in dependence on the respective demands involved in relation to the size and/or the weight of the piece goods to be loaded, and also to be able to reliably fix the piece goods at that position irrespective of the shape thereof. Basically known tightening or lashing devices are preferably to be used as the fixing means, or alternatively also fixing means from container technology insofar as that is appropriate for the piece goods to be loaded.

The invention in particular also makes use of the fact that the plurality of receiving means is arranged on the load surface in a grid: the grid is predetermined and establishes the arrangement of each location of an individual receiving means on the load surface. The provision of the grid means that it is already possible, in the preliminary stages of loading a ship (and in the preliminary stages of unloading the ship), to refer to a plan of the load surface to establish which piece goods are to be positioned at what location on the load surface because of their size and/or their weight, or which goods are to be removed when and how from on board the ship, to ensure an optimum loading and/or unloading procedure in the minimum time. In this respect the receiving means themselves are fixedly connected to the load surface and are again available for each further loading and/or unloading operation so that only the fixing means which can be connected to the receiving means have to be fitted and removed in order to secure or release the load. That is particularly advantageous in comparison with previously known approaches which provided for individually fitting receiving means for fixing means directly on the floor and/or the wall of the hold of a ship, by welding. On the one hand, that causes permanent damage to the floor and the wall of the hold while on the other hand operating personnel trained for that purpose and the use of welding equipment and material had to be provided to do that.

A development of the invention provides that the spacings between adjacent receiving means in a first direction and/or the spacings between adjacent receiving means in a second direction are the same. That provides a substantially rectangular grid on the load surface, wherein the (notional) connecting lines between the adjacent receiving means provide a substantially constant grid spacing. An advantage of that configuration is that it can be particularly easily converted and can be easily planned, on the basis of a regular pattern.

A further particularly preferred embodiment of the invention provides that the spacings between adjacent receiving means in a first direction and/or the spacings between adjacent receiving means in a second direction are different in accordance with a recurrent pattern. It has proven to be particularly advantageous if the spacings between adjacent receiving means are not kept constant along the entire extent of the grid-like arrangement of the receiving means. Variability in loading the ship and the possibility of optimum fixing of the load on the load surface of the ship can be further increased by predetermined patterning of the grid-like arrangement of the receiving means. In addition the spacings between adjacent receiving means can also be individually optimized as to which kind of piece goods are preferably transported on board the ship. Particularly preferably the recurrent pattern of the spacings between adjacent receiving means in the first and/or second directions is designed for receiving wind power installations and components of wind power installations as well as accessories for wind power installations.

In a preferred embodiment the adjacent receiving means in the first direction are spaced from each other in a range of 20 to 35 cm, or 58 to 73 cm, or 115 to 130 cm, or 160 to 175 cm. Further preferably the adjacent receiving means in the second direction are spaced from each other in a range of 18 to 33 cm, or 218 to 233 cm.

Preferably the spacings between adjacent receiving means in the first and/or second direction are arranged in the above-indicated ranges. In that case there are preferably respective groups of receiving means, which are respectively associated with one of the aforementioned ranges.

An advantageous development of the ship according to the invention provides that the load surface has a plurality of second receiving means which can be connected to fixing means and are distributed in a second grid over the load surface. It has proven to be particularly advantageous, in addition to a first grid formed from first receiving means, to provide a second grid which is optionally different from the first grid, on the load surface, the second grid being particularly preferably designed for an alternative arrangement of piece goods or further load items.

Preferably the spacings between adjacent second receiving means in a first direction and/or the spacings between adjacent second receiving means in a second direction are the same or are different in accordance with a recurrent pattern.

The same applies in regard to the advantages of this arrangement, as for the first receiving means.

Preferably the adjacent second receiving means in the first direction are spaced from each other in a range of 218 to 233 cm, or 360 to 385 cm. Further preferably the adjacent second receiving means in the second direction are spaced from each other in a range of 11.9 to 12.1 m.

In an advantageous development of the invention the load surface has a plurality of third receiving means which can be connected to fixing means, and are distributed in a third grid over the load surface. In regard to the third receiving means distributed in the third grid over the load surface, the same applies in regard to the advantages thereof, as for the above-described first and second receiving means.

In a preferred embodiment the spacings between adjacent third receiving means in a first direction and/or the spacings between adjacent third receiving means in a second direction are the same or are different in accordance with a recurrent pattern.

Preferably the adjacent third receiving means in the first direction are spaced from each other in a range of 20 to 35 cm, or 98 to 113 cm, or 218 to 233 cm, or 5.8 to 5.9 m, and/or the adjacent third receiving means in the second direction are spaced from each other in a range of 218 to 233 cm.

In a particularly preferred embodiment the spacing of an integral multiple of the first, second or third receiving means in the first direction and/or the second direction is in the range of 5.8 to 5.9 m, or 11.9 to 12.1 m. It has proven to be particularly advantageous, in regard to the variability of the load to be placed on the ship, if a respective receiving means is arranged in the above-mentioned spacing range. Preferably, it is also possible for further receiving means to be arranged between the two receiving means arranged in the above-mentioned range in the first and/or second directions, for example four to ten further receiving means which are respectively arranged in spaced relationship in one of the above-mentioned ranges. By way of example load items which in turn have receiving means corresponding to the mounting points of 20-foot or 40-foot ISO containers can also be mounted in that way on the load surface of the ship which in itself is optimized for piece goods.

In an advantageous embodiment of the ship according to the invention the first, second and/or third receiving means have openings in the load surface and the fixing means are in the form of twistlock devices which can be brought into engagement with the openings. Alternatively the receiving means have one or more projections and the fixing means are in the form of twistlock devices, preferably dovetail fittings, which can be brought into engagement with the projections.

As a further alternative the first, second and/or third receiving means are of a ring shape or a yoke shaped configuration.

The twistlock devices and/or the ring-shaped or yoke shaped openings are preferably adapted to receive tightening devices, in particular turnbuckles or further lashing means.

The fact that the receiving means are in the form of openings in which fixing means such as for example twistlocks can be engaged gives the particular advantage that the load surface is substantially flat, apart from the receiving means, and, particularly when moving around on the load surface by means of vehicles, there are no obstacles on the load surface which otherwise could impede driving around thereon or which could represent a risk of damage to the vehicles (or a risk of pedestrians tripping over).

The openings themselves are of sufficiently small size so that there is no risk of falling when walking on the openings. Consequently that construction is to be considered to be particularly advantageous for regions of the load surface which have to be walked upon and/or driven upon while the ship is sailing or also in port during loading or unloading. As an alternative thereto it is particularly advantageous to arrange on the load surface projections into which the fixing means can be engaged because such receiving means ensure greater stability of the connection to the fixing means, which is markedly perceptible in regard to the example of the dovetail fittings. The disadvantage that the above-mentioned safety risks have to be accepted due to the provision of the projections on the load surface is justifiable in particular on those parts of the load surface, which do not have to be walked upon while the ship is in operation—that is to say in particular while the ship is sailing. That particularly applies to regions of the load surface on the weather deck of the ship.

The receiving means arranged on those floor elements which form the weather deck of the ship are preferably flat. They are preferably of a height relative to the floor in a range of below 30 cm, particularly preferably below 15 cm. Particularly preferably the receiving means are aerodynamically optimized. Preferably the receiving means have side portions arranged at a shallow angle relative to the floor for example of the weather deck. That has an advantageous effect on the afflux flow characteristics of air which flows over the receiving means. The flatter the receiving means are, and the gentler the transition from the floor to the side surfaces of the receiving means, the correspondingly less is the generation of air eddies when air flows over the openings, which in turn has an advantageous effect on the fuel consumption of a ship and, particularly preferably in the case of a ship with Magnus rotors, acts as a drive on the afflux flow to the rotors. The advantage of aerodynamic optimization is particularly apparent when that part of the load surface, that forms the weather deck, is not loaded and thus is completely exposed to the afflux flow of the wind, although that already applies when the load surface is partially loaded. In a further preferred embodiment the receiving means arranged on those floor elements which form the weather deck of the ship can be closed by cover members, wherein the cover members are in turn aerodynamically optimized. Preferably at an underside the cover members have fixing means corresponding to the receiving means. Further preferably, the top side of the cover members is such that it is matched in a substantially streamlined configuration to the floor on which the covered receiving means is disposed.

Particularly preferably the load surface includes the floor of a hold and/or one or more plate-shaped floor elements. Preferably the floor elements can be respectively positioned independently at a plurality of locations and at differing heights in the hold or above the hold and can be passed in and out by means of a ship crane. In that case the ship crane can be an on-board crane specific to the ship, which is particularly preferred, or a loading crane provided in the port. The floor elements thus preferably form respective parts of the load surface, in addition to the floor of the hold of the ship, in the form of intermediate floors or cover panels. The variability in terms of loading the ship according to the invention can be still further increased by the differing positionability at various locations and at various heights.

Preferably the ship according to the invention has one or more securing elements which can be brought into engagement with two fixing means arranged in adjacent receiving means and are adapted to prevent a relative movement of the fixing means with respect to each other. The securing elements are preferably of a frame-like configuration and embrace the fixing means when they are arranged in the receiving means so that it is possible to remove the fixing means only after removal of the securing elements. As an alternative thereto the securing means can also be of a pin-shaped configuration or can be brought into engagement in the manner of a latching hook with the receiving means as soon as they are disposed in the receiving means. It has however proven to be particularly advantageous for only one respective securing element to be provided for simultaneously fixing two fixing means relative to each other because that markedly simplifies fitting and securing the fixing means in the receiving means.

The invention further concerns a floor element for a ship, in particular a cargo ship. In the case of a floor element of the aforementioned kind that object is attained in that the floor element is adapted to form a part of the load surface of the ship and has a plurality of receiving means which can be connected to fixing means and which are distributed in a grid over the load surface. The floor element is preferably adapted for use for a ship according to a preferred embodiment of the present invention. In that case the floor element is particularly preferably in the form of an intermediate floor element or a cover flap or hatch element, wherein the floor elements in the form of intermediate floors are to be arranged within the hold and the floor elements in the form of cover panels are preferably arranged at the weather deck of the ship.

The advantage of providing individual floor elements as part of the load surface is decisively due to the fact that the floor elements can be individually stored on board on the ship and also outside the ship. In that way it is possible that the individual floor elements forming part of the load surface are already provided with a load, in particular piece goods, before a ship according to the invention arrives at its berth, with the piece goods fixed thereto, and that it is only then when the ship docks that the floor elements on board the ship have to be replaced by the floor elements which have already been previously loaded and which are held in store at the port. That achieves a considerable time saving which cannot be even only approximately achieved with known ships and previously known load surface configurations.

In addition individual floor elements can be maintained externally of the ship, in the event of damage, without that causing prolonged berthing times for the ship in shipyards or ports. When a floor element suffers from a defect it can be simply replaced by an intact exchange element and the ship continues its voyage while the floor element is in the meantime being restored.

The invention further concerns a securing element which can be brought into engagement with two fixing means arranged in adjacent receiving means and which is adapted to prevent a relative movement of the fixing means with respect to each other. The securing element has a main body which in two end portions has an opening which are respectively adapted to be brought into engagement with a correspondingly shaped portion of a fixing means. The securing element makes use of the realization that the function of fixing two adjacent fixing means relative to each other in accordance with the pattern of a frame element or a clamp, can be used at the same time to fix two floor elements arranged adjacent to each other, to each other.

The securing element is preferably adapted to receive the fixing means at least partially in one or more corresponding openings in such a way that the fixing means extend with at least one fixing element completely through the securing element. In that way the fixing elements which are preferably in the form of conical, rotatable clamping or latching elements in the manner of twistlocks can still perform a securing function, in spite of the securing element which is present.

Preferably the securing element has a bar which is adapted to secure the securing element to a floor element, insofar as the fixing element of a fixing means accommodated in the floor element can be brought into engagement therewith or can be engaged therebehind. Thus, one side of the securing element is used as a securing means for that purpose while another side of the securing element has an opening through which the unused fixing element of a fixing means extends to a piece good item to be fixed, a container or the like.

In a preferred embodiment the ship according to the invention has at least one Magnus rotor, particularly preferably four Magnus rotors. Magnus rotors are also referred to as Flettner rotors or sailing rotors. Such rotors are preferably in the form of cylinders. Rotation of the Magnus rotors results in the generation of a force directed transversely relative to the direction of the fluid flowing to the rotor in afflux relationship.

The Magnus rotor or rotors can be rotated by means of electrical energy provided by an energy supply system. In a ship having four Magnus rotors the Magnus rotors are particularly preferably arranged at the bow and stern corners of the ship. The hold which accommodates the load surface is limited in its length both at the bow and at the stern of the ship, by the arrangement of the Magnus rotors. The hold with its load surface is preferably adapted to provide a maximum surface area in the ship between the Magnus rotors.

In a preferred embodiment the ship according to the invention further has a ship crane adapted to remove at least one diesel-electric system which is used on the ship preferably for providing electrical energy for the ship drive and/or the drive for the Magnus rotors, from the interior of the ship and/or to introduce it into the interior of the ship. Particularly preferably a plurality of diesel-electric systems are arranged within the ship and beneath a respective common opening. In a particularly preferred embodiment the common opening can be closed by means of a floor element according to the invention.

The ship crane is preferably so arranged that it passes into the room in which the diesel-electric systems are arranged by letting down a crane hook through the hold and through the common opening. The ship crane therefore makes it possible to replace diesel-electric systems in any port or at any dock, irrespective of whether there is a crane on the shore or not. The ship crane is preferably also capable of lifting or lowering the floor element which optionally represents the cover for the common opening.

In a particularly preferred embodiment there is no need to previously remove the load which is possibly still on board the ship, for the process of changing over one or more diesel-electric systems. Piece goods which are fixed on a floor element by means of the fixing means can preferably be lifted together with the floor element and moved to the side in order to give a clear access to the diesel-electric system or systems. After the replacement operation has taken place, the load can then be placed again together with the floor element over the opening for the diesel-electric system or systems and the hold or the load surface is closed.

BRIEF DESCRIPTION OF THE SEVERAL VIEWS OF THE DRAWINGS

The present invention is described in detail hereinafter by means of preferred embodiments and with reference to the accompanying drawings in which.

DETAILED DESCRIPTION

Figure 1:
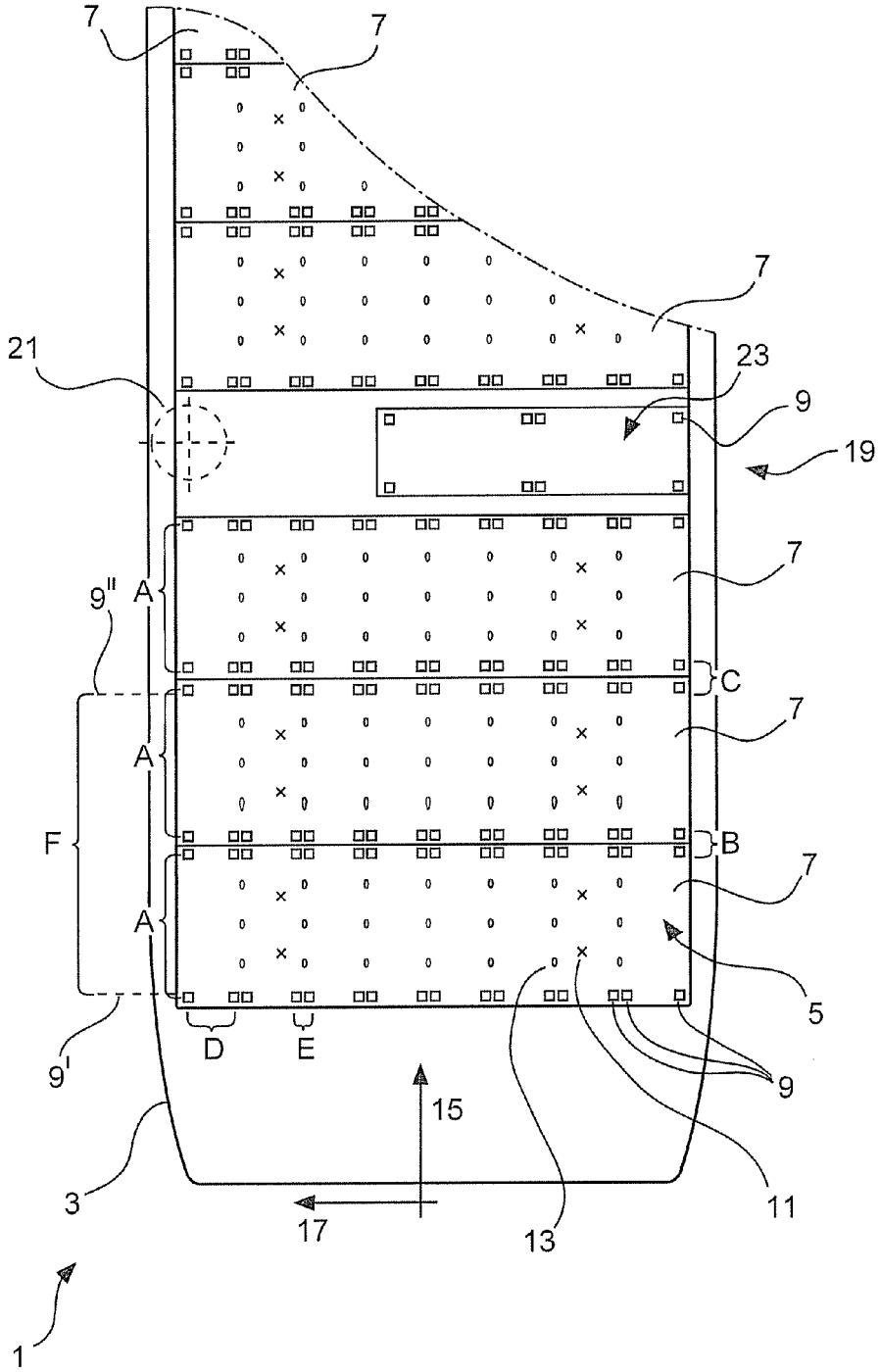
FIG. 1 shows a cut-away plan view of a ship in a first preferred embodiment.

FIG. 1 is a diagrammatic plan view showing the stern part of a ship 1. The illustrated ship 1 has a hull 3. Provided in the hull 3 is a hold 5. The hold 5 is closed by means of a plurality of floor elements in the form of cover panels 7. The floor elements form a part of the load surface of the ship 1. A multiplicity of receiving means 9, 11, 13 is arranged on the storage surface including the floor elements in the form of the cover panels 7. The receiving means 9, 11, 13 are arranged in various grid configurations along the load surface.

As shown in FIG. 1 a grid with first receiving means 13 is arranged on the load surface formed by the floor elements 7. The first receiving means 13 are substantially uniformly spaced from each other in a first direction 15 (longitudinal direction of the ship 1) and in the second direction 17 (transverse direction of the ship 1).

The floor elements 7 of the load surface further have a second grid, along which the second receiving means 11 are arranged. As can also be seen in detail from FIG. 3 the second receiving means 11 are arranged in the first direction alternately at a spacing G and a spacing H relative to each other. In the second direction 17 the second receiving means 11 are spaced at a spacing I. In the present illustrated example the spacing I is equal to the spacing F and is in the range of 11.9 to 12.1 m, particularly preferably between 11.98 m and 12.0 m.

The spacing G is in the range of 218 to 233 cm and the spacing H is in the range of 360 to 386 cm. Particularly preferably the spacing G is between 225 and 227 cm and the spacing H is particularly preferably between 368 cm and 370 cm.

Third receiving means 9 are arranged in a third grid extending in the first direction 15 (longitudinal direction of the ship) and in the second direction 17 (transverse direction of the ship). The third receiving means 9 are spaced differently from each other in the first direction in accordance with a recurrent pattern. In the first direction the third receiving means 9, viewed from the left, are spaced from each other at a spacing A, then at a spacing B, then again at a spacing A and then at a spacing C and finally again at a spacing A. The three cover panels 7 arranged in the stern are separated from the next cover panels 7 which are shown at the right-hand portion in FIG. 1 by a crosspiece 19. The crosspiece 19 extends from the port side to the starboard side of the ship 1.

The spacing A is in the range of 5.8 to 5.9 m, the spacing B is in the range of 20 to 35 cm and the spacing C is in the range of 98 to 113 cm. Particularly preferably the spacing A is between 5.84 and 5.86 m, the spacing B is between 27 and 29 cm and the spacing C is between 105 and 107 cm.

The third receiving means 9 are arranged alternately relative to each other in the second direction 17 at a spacing Dora spacing E.

The spacing D is in the range of 218 to 233 cm and the spacing E is in the range of 20 to 35 cm. Particularly preferably the spacing D is in the range of 225 cm to 227 cm.

The third receiving means 9 are further arranged in the first direction 15 in spaced relationship such that the spacing between a first row 9' of third receiving means and a fourth row 9" of third receiving means is the spacing F.

The spacing F is in the range of 11.9 to 12.1 m, particularly preferably in the range of 11.98 to 12.0 m.

As shown in FIG. 1 the third receiving means 9 are in the form of projections for receiving dovetail fittings. The second receiving means 11 are adapted as openings for receiving twistlocks. The first receiving means 13 are in the form of substantially ring-shaped eyes or D-rings. Arranged in the region of the crosspiece 19 of the ship 1 on the port side is a multiplicity of cranes, of which one crane 21 is indicated. A portion 23 extends on the crosspiece 19 from the starboard side in the direction of the port side. A multiplicity of third receiving means 9 are arranged in the portion 23. The third receiving means 9 arranged in the portion 23 are arranged turned through 90° in comparison with the third receiving means 9 of the grid provided on the load surface formed by the cover panels 7.

Optionally first receiving means 13 (not shown) are also arranged in the portion 23, those receiving means 13 also being turned through 90° in comparison with the first receiving means 13 on the cover panels 7.

Figure 2:
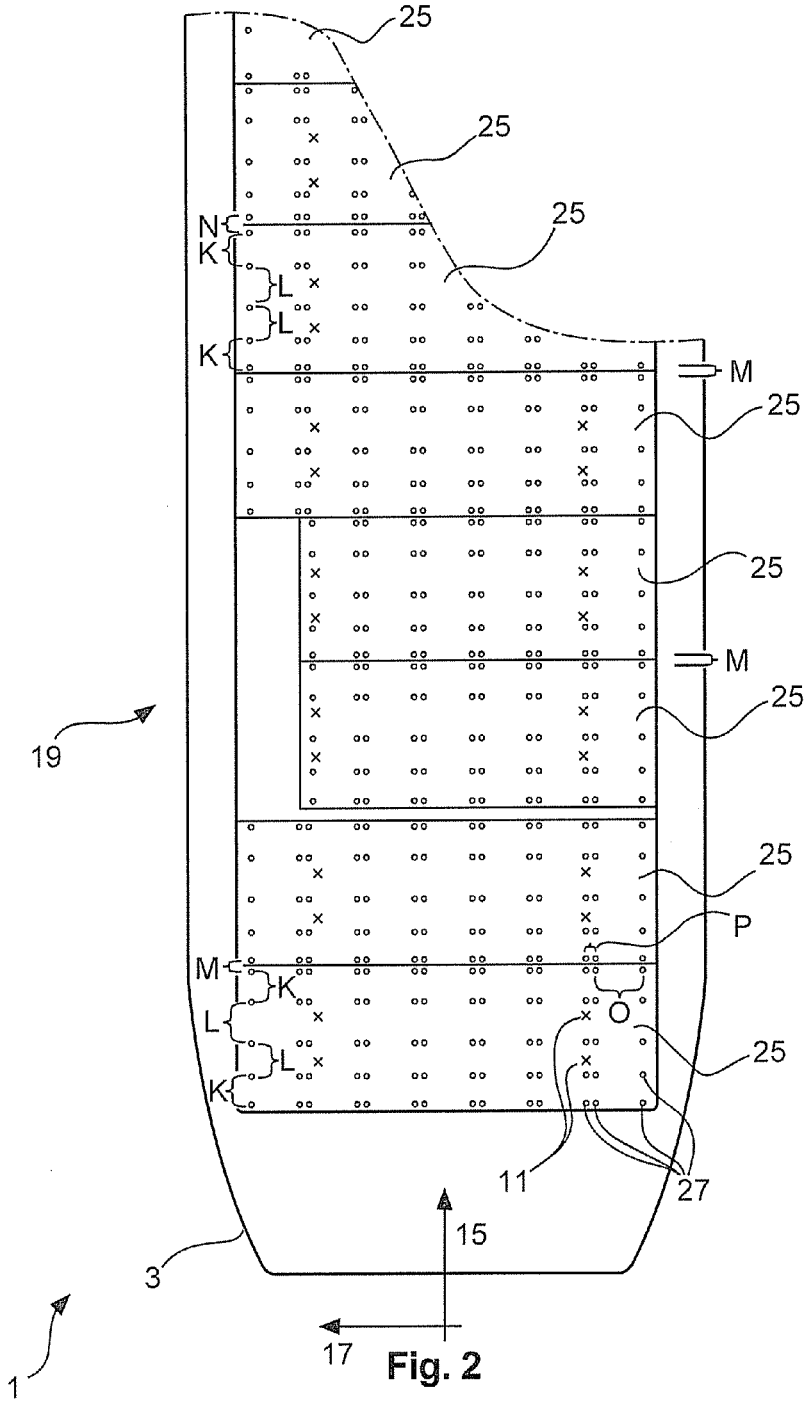
FIG. 2 shows a cut-away plan view of a ship according to the invention in a second preferred embodiment.

FIG. 2 shows a ship 1 according to an alternative embodiment. The ship 1 shown in FIG. 2 has a configuration for the load surface which is formed from a plurality of floor elements in the form of intermediate floors 25. A plurality of first receiving means 27 is arranged in a first grid on the storage surface including the intermediate floors 25. The first receiving means 27 are arranged at different spacings from each other in the first direction 15 in accordance with a recurrent pattern. The receiving means 27 which are respectively adjacent in the first direction are spaced from each other in succession at a spacing K, then a spacing L, then a spacing L, then again a spacing K and finally a spacing M. Then the receiving means are spaced from each other at a spacing K, then a spacing L, then again a spacing L, then again a spacing K and finally a spacing N.

The spacing K is in the range of 115 to 130 cm, particularly preferably 123 cm to 124 cm, the spacing L is in the range of 160 to 175 cm, particularly preferably 168 cm to 170 cm, the spacing M is in the range of 20 to 35 cm, particularly preferably 27 cm to 29 cm, and the spacing N is in the range of 58 to 73 cm, particularly preferably 65 to 67 cm.

In the second direction 17 the first receiving means 27 are alternately spaced relative to each other at a spacing O and a spacing P.

The spacing O is in the range of 218 to 233 cm, particularly preferably 225 cm to 227 cm, and the spacing P is in the range of 18 to 33 cm.

A plurality of second receiving means 11 is arranged on the load surface in the same way as the second receiving means 11 along the second grid shown in FIG. 1. In accordance with the present view, in the region 19 of the ship 1, two floor elements in the form of intermediate floors 25 are of a shortened nature, in comparison with the other intermediate floors 25.

What is common to the two embodiments of FIG. 1 and FIG. 2 is that the floor elements 7, 25 can all be individually removed from the ship or fitted to the ship by means of the crane which is specific to the ship, or an external crane. FIG. 2 admittedly does not show that the floor elements in the form of the intermediate floors 25 can also be arranged at different heights relative to each other. It will be noted however that this is preferably the case.

Figure 3:
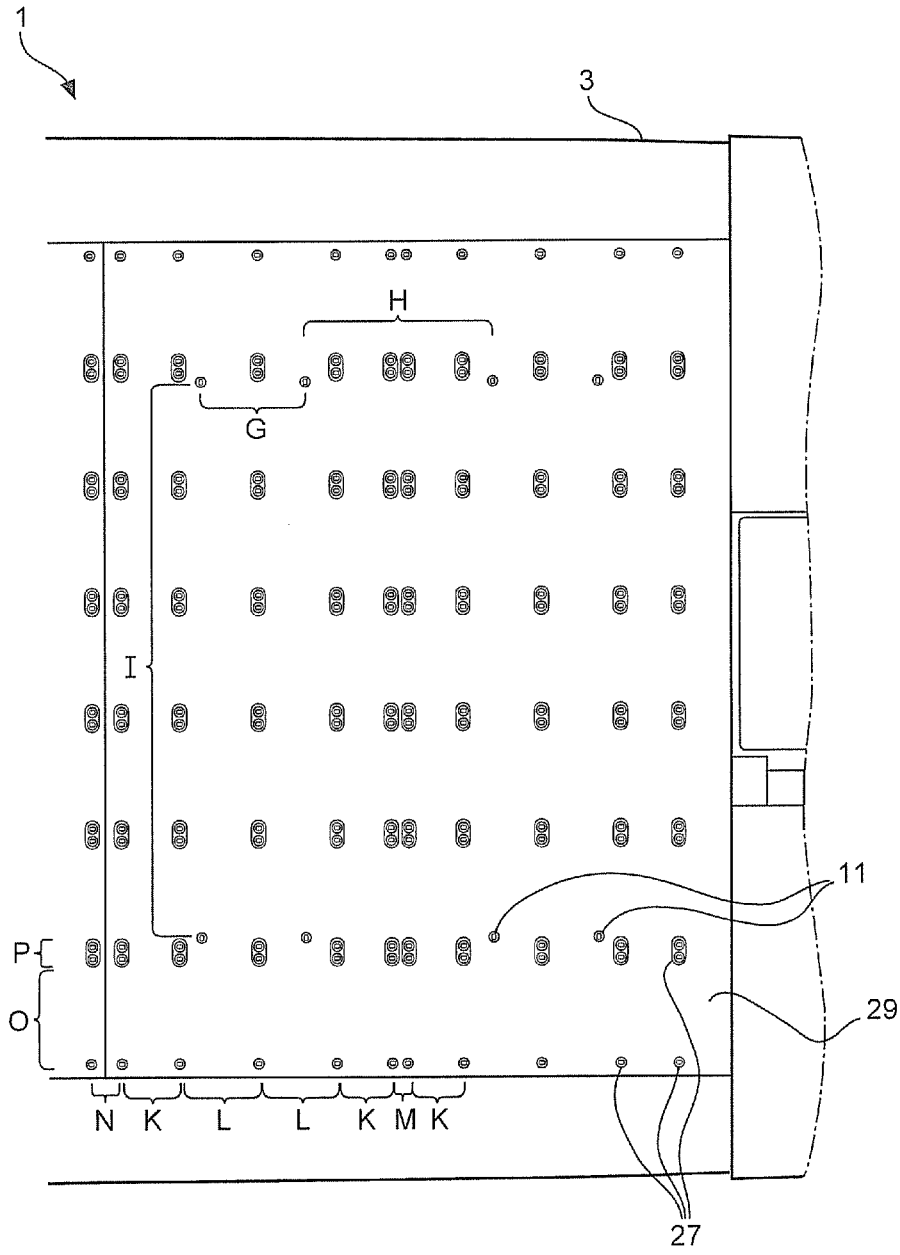
FIG. 3 shows a detail view of a ship in a third preferred embodiment.

FIG. 3 shows a floor element in the form of an intermediate floor 29 of the load surface of a ship 1 according to this invention. The load surface is arranged within the hull 3 of the ship 1. The intermediate floor 29 of FIG. 3 differs from the intermediate floors 25 in FIG. 2 in that it is substantially twice as wide as the intermediate floors 25. The first grid and the second grid of the first receiving means 27 and the second receiving means 11 respectively are however unchanged in comparison with FIG. 2. In that respect attention is directed to the foregoing description relating to FIG. 2.

The first and second receiving means 11, 27 shown in FIG. 3 are in the form of openings. The openings are fitted in the manner of cups in the intermediate floors 29 of the ship 1 and do not project. Only the weld seams may under some circumstances represent a minimum curvature on the load surface, formed by the intermediate floors 29. That however can also be minimized by means of suitable production processes.

Basically the first receiving means 27 and the second receiving means 11 in FIG. 3 are receiving means of identical configuration. The second receiving means 11 are however turned through 90° with respect to the first receiving means 27 of the FIG. 3 embodiment. In accordance with an optional configuration, that also applies to FIG. 2, whereby then the second receiving means 11 are arranged turned through 90° relative to the first receiving means 27 of FIG. 2.

Figure 4:
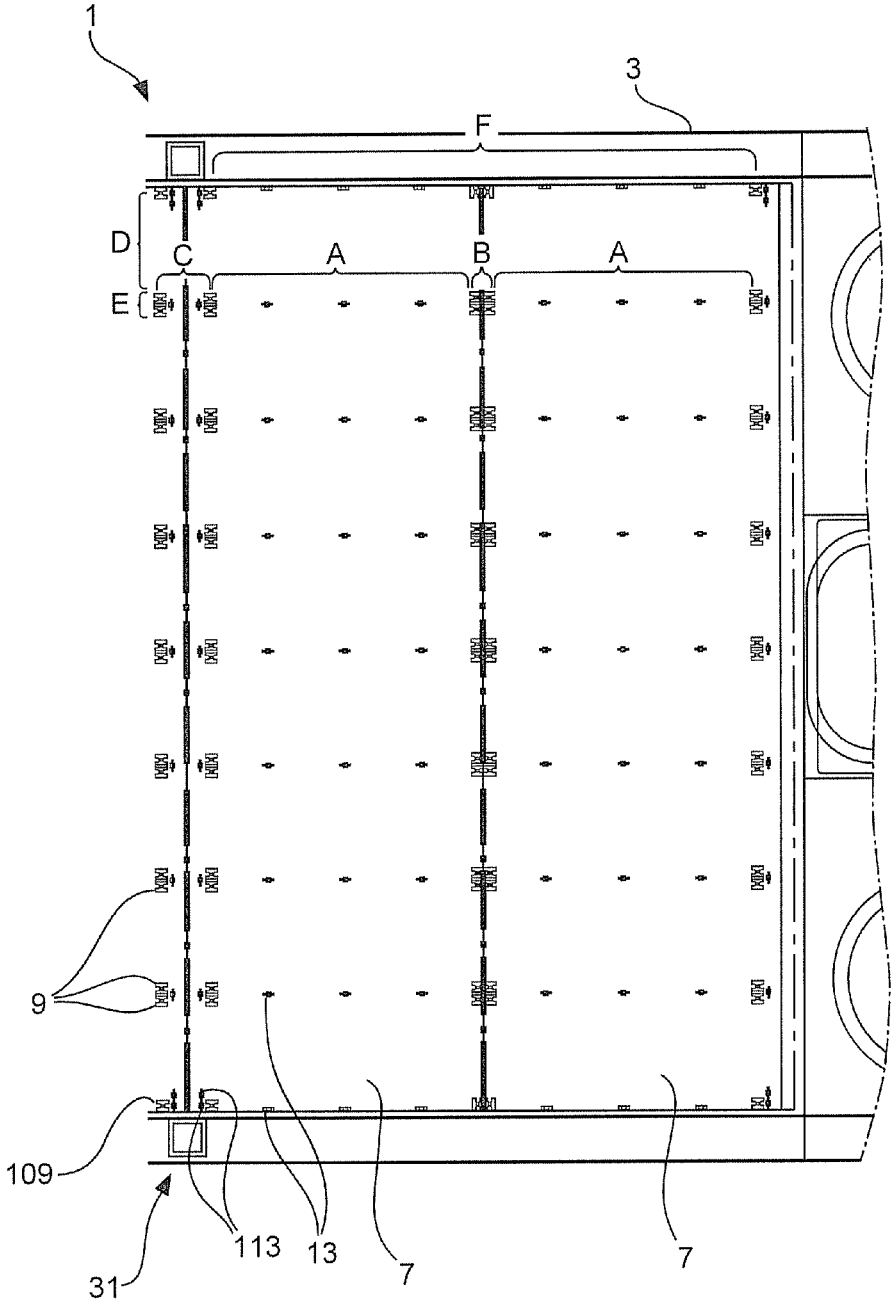
FIG. 4 shows a detail view of the ship of FIG. 1.

FIG. 4 shows a detail view of the arrangement of the receiving means of FIG. 1. In that respect reference is directed to the foregoing description relating to FIG. 1. Shown here is a portion from the bow region of the ship 1. In the embodiment shown in FIG. 4 the first receiving means 13 are substantially identically and regularly shaped and distributed over the load surface of the ship 1. An exception is formed by the receiving means in a portion 31. In the portion 31, two respective receiving means 113 are arranged in the edge region of two adjacent floor elements 7. The receiving means 113 correspond to the first receiving means 13 in shape and configuration, but it will be seen that they are arranged directly next to each other and turned through 90° in comparison with the first receiving means 13.

Likewise, arranged in the portion 31 are two dovetail receiving means 109 which admittedly correspond to the shape and configuration of the third receiving means 9, but are arranged turned through 90° in comparison therewith in the edge region of the floor elements 7.

Arranging the receiving means in an orientation turned through 90°, when dealing with piece good fixings, permits the position of the piece goods on the floor elements 7 to be better established in statistically determined fashion.

Figure 5:
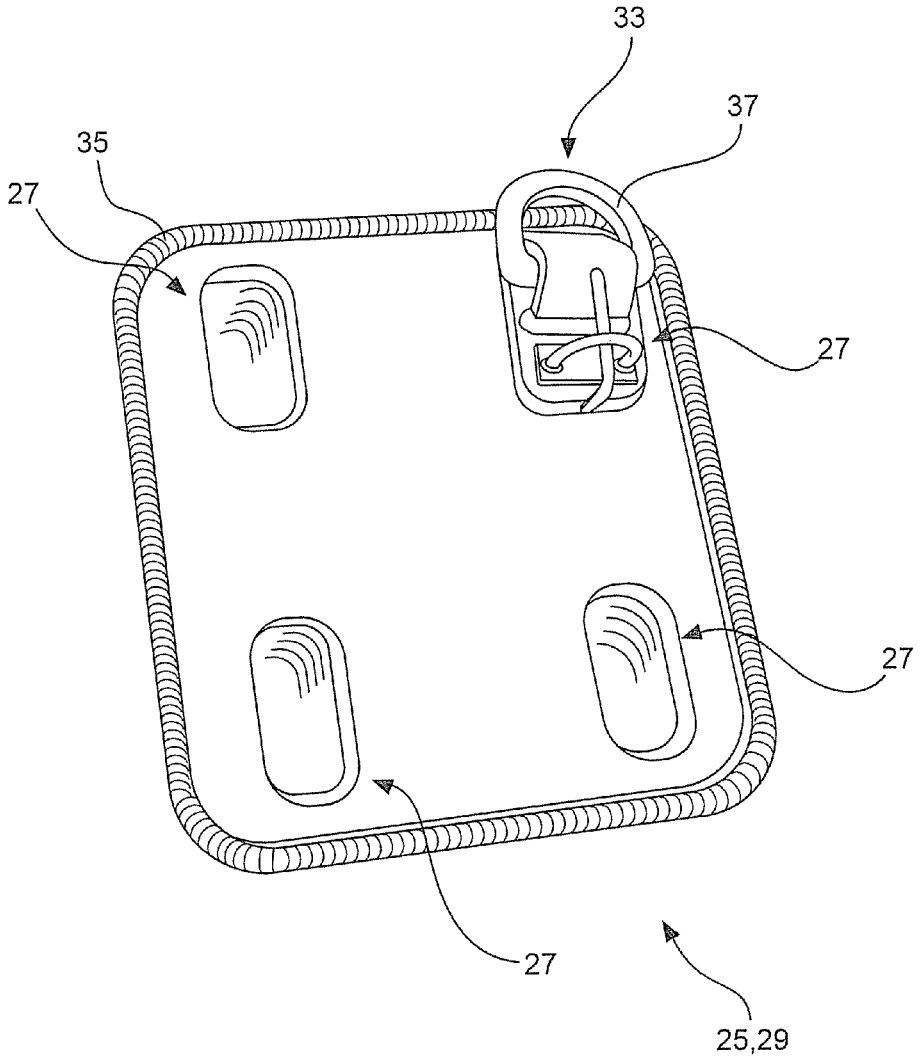
FIG. 5 shows a detail view of a storage surface of a ship in a fourth preferred embodiment.

FIG. 5 shows a detail view of the surface of a floor element in the form of an intermediate floor 25 or intermediate floor 29. In particular FIG. 5 shows mounting of the total of four first receiving means 27. The total of four first receiving means 27 are arranged in a quartet in a 2×2 orientation in the form of openings in a common panel. The panel is fitted into the surface of the intermediate floor 25 or 29 by means of a peripheral weld seam 35. By way of example a fixing means 33 is fitted into one of the openings 27. The fixing means 33 is a twistlock with a mounting ring 37 mounted externally to the twistlock. As an alternative to the illustrated twistlock it is also possible to fit other fixing means in the receiving means 27. The respective choice is to be adapted to the specific situation of use.

Figure 6:
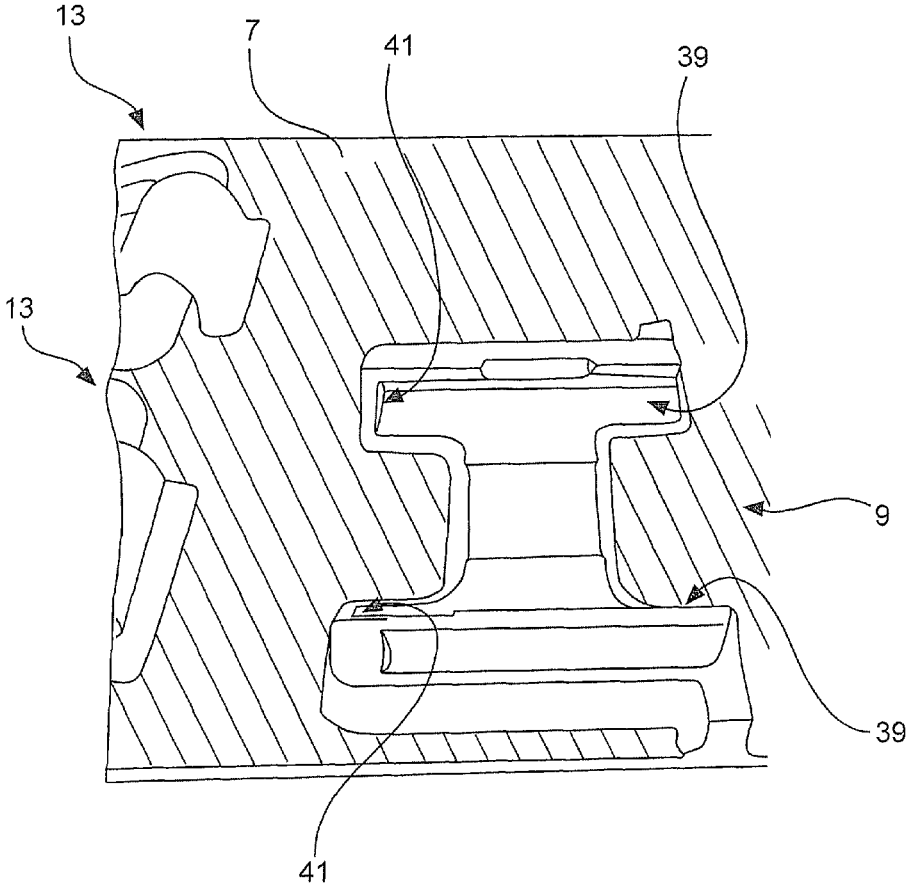
FIG. 6 shows a perspective view of a detail of the ship of FIG. 4 with a securing element.

FIG. 6 is an inclined view from above showing part of a floor element in the form of a cover panel 7. A third receiving means 9 is provided in the form of a projection on the floor element in the form of the cover panel 7. Viewed from above the third receiving means 11 is approximately in the shape of a letter H. It is adapted to receive dovetail insertions. In the illustrated orientation, the dovetail insertions are inserted from the right into the third receiving means 9. For that purpose the third receiving means 9 has two negatively conical portions 39, wherein the portions, of a corresponding configuration, of the dovetail insert can be brought into engagement therebehind. An abutment 41 is provided at both sides at an end of the portions 39, which end is at the left in the illustrated orientation. The abutment 41 serves in each case as a support for the dovetail inserts which are to be inserted.

In addition to the third opening 9 indicated at the left-hand edge of the Figure are two first receiving means 13 in the form of ring-shaped receiving means.

Figure 7:
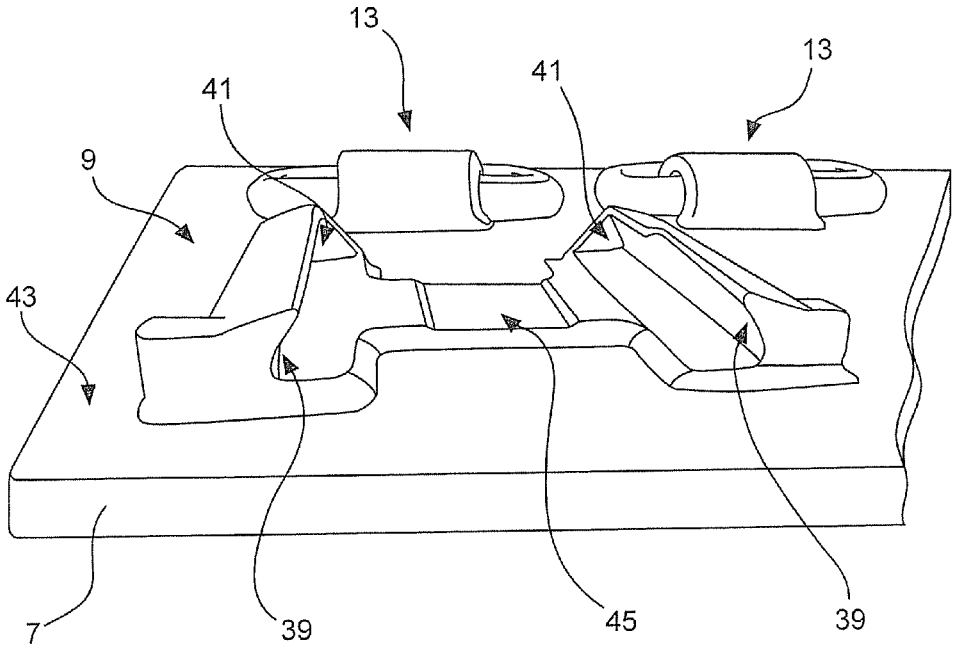
FIG. 7 shows an alternative view of the illustration in FIG. 6.

FIG. 7 shows the situation which is also already illustrated in FIG. 6 from a different angle. It can be clearly seen on the top side 43 of the floor elements 7 which are in the form of a cover panel (one thereof being shown in FIG. 7) that the third receiving means 9 protrudes like a projection from the surface 43. There is a clear view on to the negatively conical portions 39 and the abutment surfaces 41. A further recess 45 is provided in the substantially H-shaped profile, in the center between the two portions 39. The receiving means 9 is aerodynamically optimized. It has inclinedly extending side portions, within which the portions 39 are formed.

Figure 8:
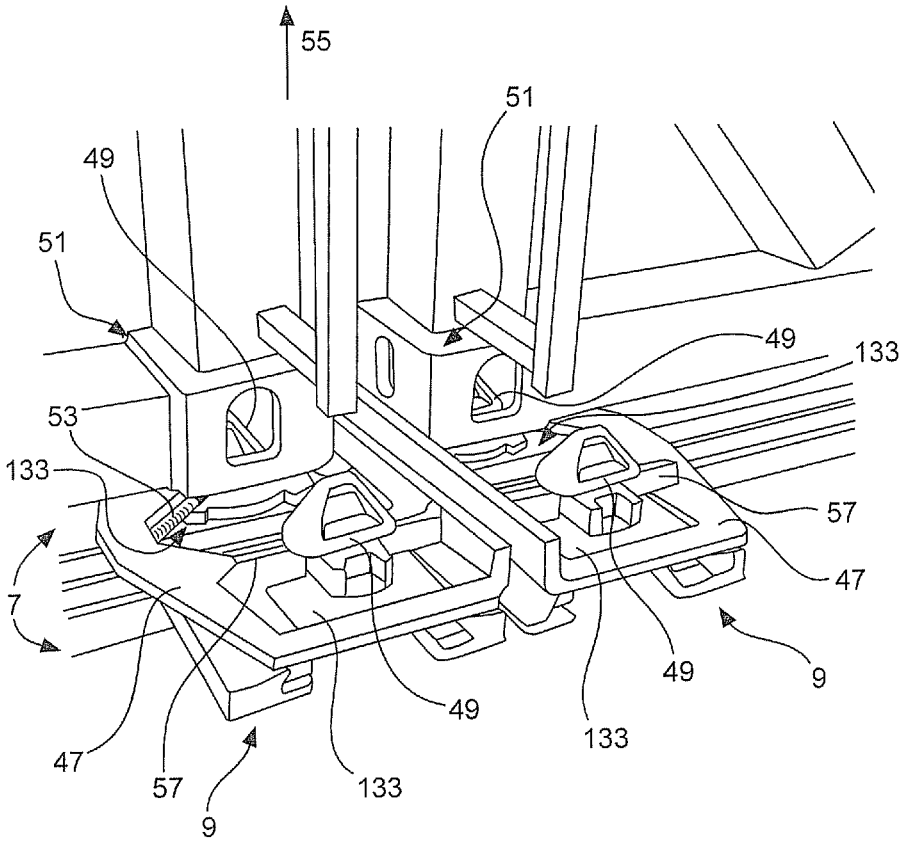
FIG. 8 shows a perspective view of an installation situation on a ship according to the invention in accordance with the first embodiment with a securing element.

FIG. 8 shows an installation situation for the third receiving means 9 of FIGS. 6 and 7. Two third receiving means 9 are arranged at each two adjacent floor elements 7 which are in the form of cover panels. Respective fixing means 133 are laterally inserted into the third receiving means 9.

Each two oppositely disposed fixing elements 133 are secured relative to each other by means of a securing element. The securing element 47 is in positively locking engagement with the respective two oppositely disposed fixing means 133. As shown in FIG. 8 the fixing means 133 are in the form of dovetail inserts and have conical portions 49 at a top side. The conical portions 49 are adapted to engage into standardized corner fitments. Two of those corner fitments are shown in the form of corner fitments 51 in engagement with a respective conical portion 49.

The corner fitments 51 are part of a respective rotor blade receiving means. The rotor blade receiving means has a frame which contains the corner fitments 51. The rotor blades of a wind power installation are fixed to the receiving means by means of screwing or pin means and the receiving means is in turn fixed by means of the fixing means 133 on board the ship in the present case to the deck. The conical portions 49 are mounted rotatably through 90° by means of an adjusting lever 53 in the fixing means 133. After the conical portions 59 engage into the corner fitments 51 the conical portions 59 are rotated through 90° by means of the adjusting lever 53 and the corner fitments 51 are locked.

As, in spite of the in part considerable weight of the items to be locked, as a consequence of thrust forces or vibration, those items have to be secured in a vertical direction 55, the securing element 47 has a respective bar 57 with which a conical portion 49 can be brought into engagement therebehind, in a similar manner as with a corner fitment. The bar 57 ensures that the securing element 47 cannot be unintentionally lifted or removed.

In an alternative configuration of the invention the receiving means 9 on the floor elements 7 in the form of the cover panels can be arranged rotated alternately through 90° to provide a support for the piece goods to prevent movements in both directions, when fixing piece goods to two adjacent receiving means. To fix the piece goods by means of two receiving means which are not arranged in mutually adjacent relationship, but by means of one receiving means and a receiving means which is next-but-one relative thereto, the securing element 47 is adapted to provide an additional securing action.

Figure 9:
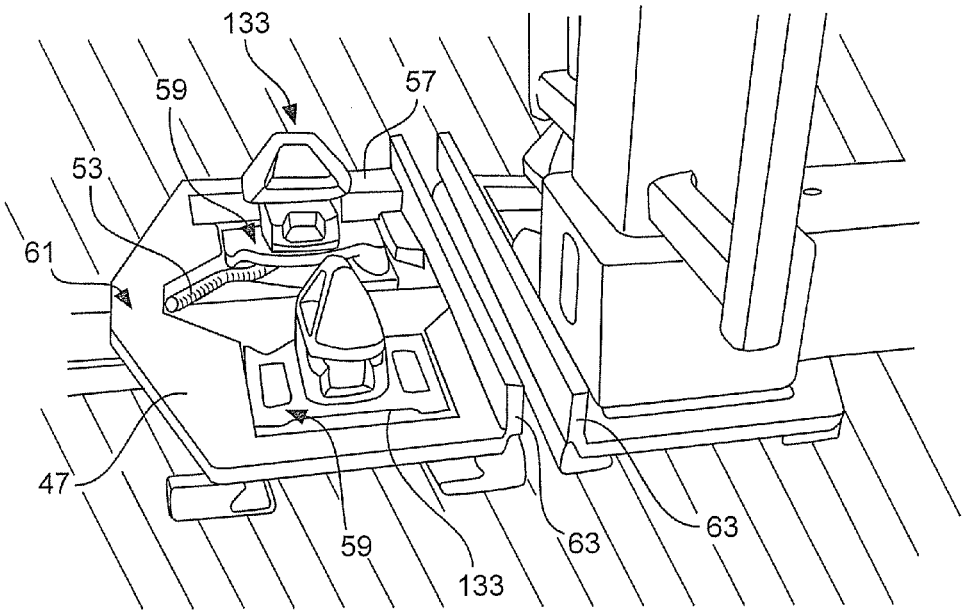
FIG. 9 shows a further detail view of a securing element for a ship in the installation situation.

One of the securing elements shown in FIG. 8 is illustrated again in FIG. 9. It can be seen that the securing element 47 embraces two substantially rectangular portions of the fixing portions 59 of the fixing means 133. For that purpose provided in the securing element is an opening corresponding to the substantially rectangular portions of the fixing means. Provided in a central portion 61 of the securing element 47 is a polygonal opening permitting access to the adjusting lever 53 of the fixing means 133. In addition the securing element has a bar 63 which serves as a positioning aid for goods items which are to be placed on the securing element and fixed to the fixing means 133. The bar 63 serves also as an abutment for that purpose. The securing element 47, insofar as it has two bars 57 (not shown), can also be used for fixing two adjacent floor elements 7 in the form of cover panels.

Figure 10:
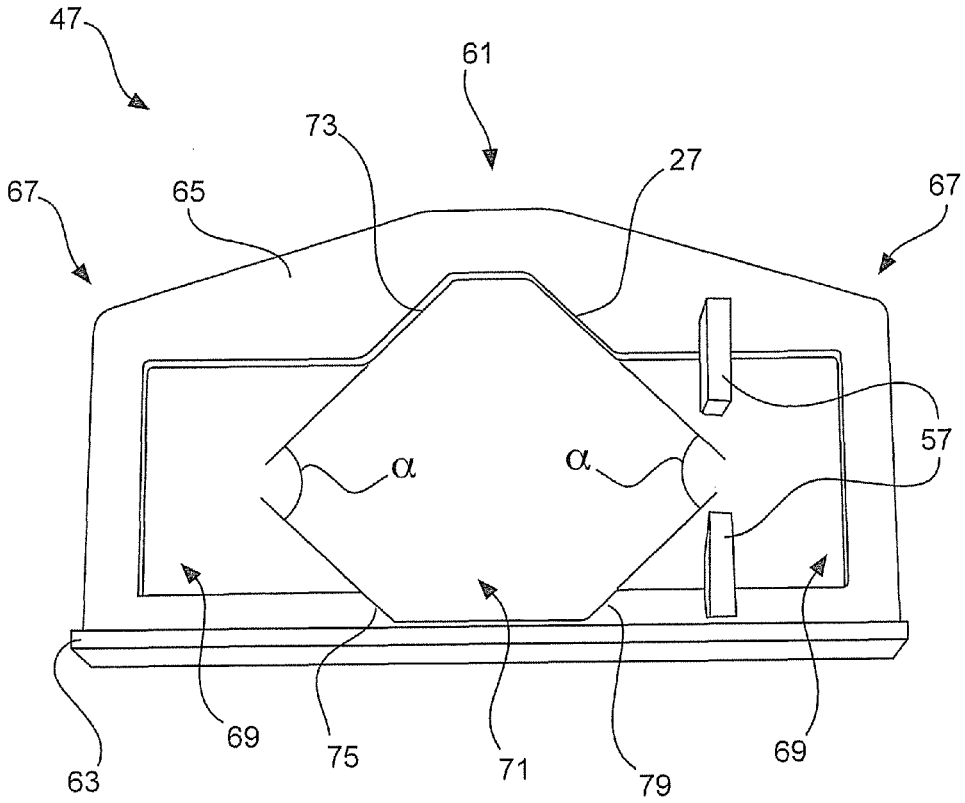
FIG. 10 shows a perspective view of a securing element for the ship according to the invention.

FIG. 10 shows the securing element 47 in isolation. The securing element 47 has a main body 65. The main body 65 is subdivided into a central portion 61 and two end portions 67. The main body 65 has an opening extending completely through the main body 65. The opening has a substantially rectangular opening 69 in each of the end portions 67. The opening 69 is adapted to embrace in positively locking relationship a respective fixing means of appropriate configuration such as for example a dovetail insert. A bar 57 is arranged in one of the end portions 67 (preferably in both end portions 67). The bar 57 is fixedly connected to the main body 65 and in the center has an opening extending completely through the bar 57. The opening is of such dimensions that a conical portion of the fixing means can extend in a first position through the opening and in a second position comes into engagement behind the bar 57. The conical portion is part of a fixing element, in the form of a twistlock, of the fixing means.

A polygonal opening 71 is provided in the central portion 61 of the opening of the securing element 47. The polygonal opening in the present Figure is octagonal. A first edge 73 is arranged at an angle $\alpha$ relative to a second edge 75. Particularly preferably the angle $\alpha=90°$ or greater. A third edge 77 and a fourth edge 79 can also be arranged at the angle $\alpha$ relative to each other. Particularly preferably the angle $\alpha$ corresponds at least to the angle of movement of an adjusting lever of the fixing means embraced at the securing element 47. A larger angle facilitates the freedom for gripping the adjusting lever of a fixing means, but requires an increased amount of space and material. The adjusting lever of the fixing means is accessible in any operative position through the opening 71.

A bar 63 serves as a positioning aid and abutment for goods items which are to be connected with the fixing means above the securing element.

The securing element shown in FIG. 10 advantageously combines two functions: it ensures fixing of two adjacent floor elements relative to each other and at the same time it is adapted to fix one or two by means of the fixing means 133 relative to the respectively adjacent floor element.

Figure 11:
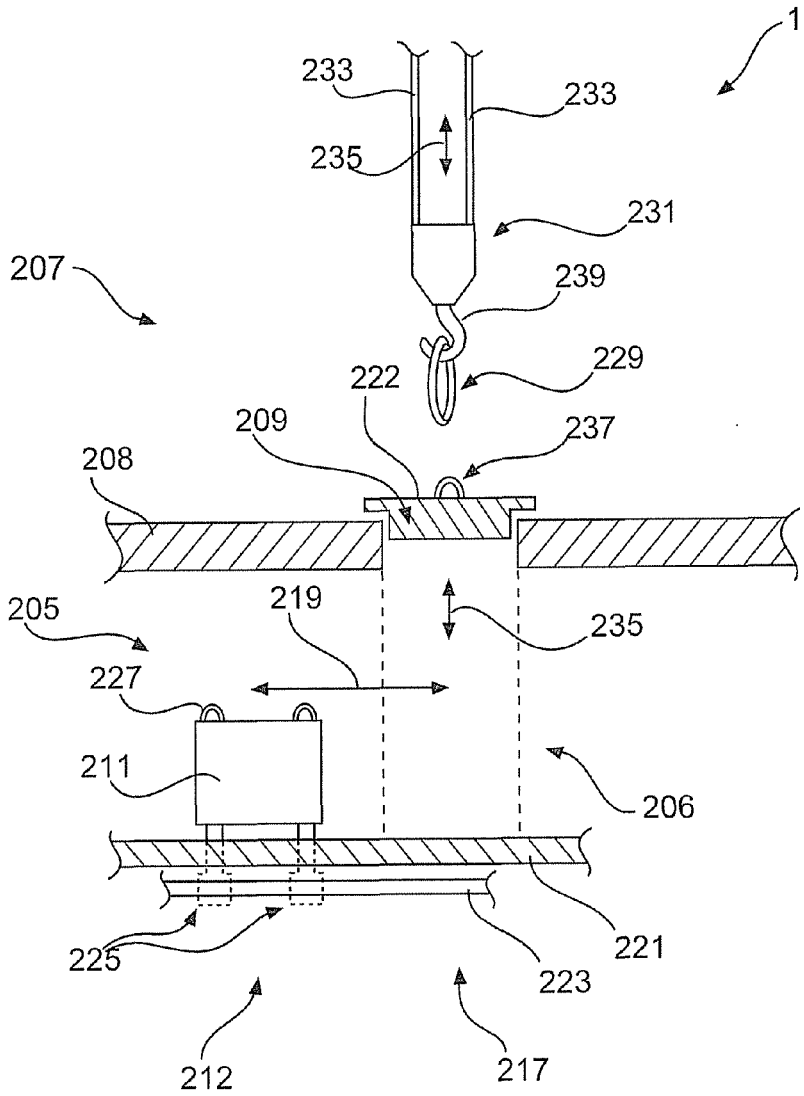
FIG. 11 shows a cross-sectional view of a portion of the ship according to the invention.

FIG. 11 shows a diagrammatic cross-sectional view or side view of a room 205 in the form of an engine room beneath the hold 207. The hold 207 and the room 205 therebeneath are separated by a ceiling 208. The ceiling 208 preferably forms the floor of the hold 207 and is thus part of the loading surface. Provided in the ceiling 208 is an opening 209 which extends completely through the ceiling 208 and which is closed by means of a cover member 222. Alternatively the cover member is not in the form of a separate cover member 222 as shown in FIG. 11 but is in the form of a floor element according to the present invention. In this respect attention is directed to the foregoing description relating to the floor element.

Arranged within the room 205 is a plurality of diesel-electric systems 211, only one diesel-electric system 211 being shown in FIG. 3. The diesel-electric system 211 is arrested in an operating position 212 by means of fixing elements (not shown). Arranged beneath the diesel-electric system 211 is a plurality of rails 223 serving as displacement means. Arranged between the diesel-electric system 211 and the rails 223 are floor panels 211 which make it possible to walk in the space 205 without a disturbing influence in respect of the rails 223. At its top side the diesel-electric system 211 has a plurality of fitments 227 for fitting force transmission means such as for example cables, chains, hooks and so forth. The replacement of a diesel-electric system is effected by the diesel-electric system being moved from its operating position 212 into a mounting/removal position 217. For that purpose firstly the floor panels 221 which interfere with the movement of the diesel-electric system 211 are removed or moved to the side. Then the diesel-electric system 211 is brought into contact with the rails 223 in the region of the displacement portions 225. That can be effected by raising or lowering the diesel-electric system 211, for example by means of a block-and-tackle. As soon as the diesel-electric system 211 is freed from any fixing means and has been brought into contact with the rails 223 the diesel-electric system 211 is moved from the operating position 212 into the mounting/removal position 217 in the direction of the arrow 219. All this can preferably be prepared and implemented before the ship has reached a port. After the port is reached only the cover member 222 which particularly preferably is in the form of a floor element according to the invention is removed from the opening 209 by means of a crane 231.

The crane 231 is preferably a ship-mounted crane as is also arranged in FIG. 1 in the form of the crane 21. For that purpose the crane 231 has a crane hook 239 on which a fixing means 229 is arranged. The fixing means 229 can be a shackle cable, carrier cable, chain or the like. The crane 231 is moved by means of a block-and-tackle 233 downwardly in the direction of the arrow 235 through the opening 209. The diesel-electric system 211 which is in the mounting/removal position is then brought into contact at the fitments 27 with the force transmission means 229 and lifted also in the direction of the arrow 235 by means of the crane 231. Optionally it is possible to move the diesel-electric system 211 by means of the crane into the interior of the hold, from which it is moved away with conventional vehicles, or for the diesel-electric system to be lifted entirely off the ship by means of the crane 231. Then if required a new or maintained diesel-electric system is moved into the interior of the ship by means of the crane 231 in an identical but reversed procedure, and displaced from the mounting/removal position into the operating position 212.

The various embodiments described above can be combined to provide further embodiments. All of the U.S. patents, U.S. patent application publications, U.S. patent applications, foreign patents, foreign patent applications and non-patent publications referred to in this specification and/or listed in the Application Data Sheet are incorporated herein by reference, in their entirety. Aspects of the embodiments can be modified, if necessary to employ concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A cargo ship comprising:

a hold; and a load surface that includes a plurality of moveable plate elements, the plate elements being configured to move between a plurality of locations in the hold, the locations including a floor surface of the hold and a raised surface in the hold, the load surface having a plurality of receiving means that are configured to be connected to fixing means, the receiving means being distributed in a grid over the load surface.

2. The ship according to claim 1 wherein at least one of spacings between adjacent receiving means in a first direction and spacings between adjacent receiving means in a second direction are substantially the same.

3. The ship according to claim 1 wherein at least one of spacings between adjacent receiving means in a first direction and spacings between adjacent receiving means in a second direction are different in accordance with a recurrent pattern.

4. The ship according to claim 3 wherein the adjacent receiving means in the first direction are spaced from each other in a range of at least one of the following:

20 to 35 cm, 58 to 73 cm, 115 to 130 cm, and 160 to 175 cm, and wherein the adjacent receiving means in the second direction are spaced from each other in a range of at least one of the following:

18 to 33 cm, and 218 to 233 cm.

5. The ship according to claim 1 wherein the receiving means are first receiving means, the load surface include a plurality of second receiving means that are configured to be connected to the fixing means, the second receiving means being distributed in a second grid over the load surface.

6. The ship according to claim 5 wherein spacings between adjacent second receiving means in a first direction spacings between adjacent second receiving means in a second direction are one of the same or are different in accordance with a recurrent pattern.

7. The ship according to claim 5 wherein the adjacent second receiving means in the first direction are spaced from each other in a range of at least one of the following:

218 to 233 cm, and360 to 385 cm, and wherein the adjacent second receiving means in the second direction are spaced from each other in a range of 11.9 to 12.1 m.

8. The ship according to claim 1 wherein the load surface has a plurality of third receiving means that are configured to be connected to fixing means and are distributed in a third grid over the load surface.

9. The ship according to claim 8 wherein spacings between adjacent third receiving means in a first direction and spacings between adjacent third receiving means in a second direction are the same or are different in accordance with a recurrent pattern.

10. The ship according to claim 8 wherein the adjacent third receiving means in the first direction are spaced from each other in a range of at least one of the following:

20 to 35 cm, 98 to 113 cm, 218 to 233 cm, and 5.8 to 5.9 m, and wherein the adjacent third receiving means in the second direction are spaced from each other in a range of 218 to 233 cm.

11. The ship according to claim 1 wherein the spacing of an integral multiple of the first, second or third receiving means in the first direction and/or the second direction is in the range of at least one of the following:

5.8 to 5.9 m, and 11.9 to 12.1 m.

12. The ship according to claim 1 wherein at least one of the first, second and third receiving means include:

openings in the load surface, and the fixing means are in the form of twistlock devices that are configured to be brought into engagement with the openings;

one or more projections and the fixing means are in the form of twistlock devices that are configured to be brought into engagement with the projections; or a ring shape or a yoke shape.

13. The ship according to claim 1 wherein the plate elements are configured to be moved in and out of the ship by a ship crane.

14. The ship according to claim 12 wherein one or more securing elements can be brought into engagement with two fixing means arranged in adjacent receiving means and are adapted to prevent a relative movement of the fixing means with respect to each other.

15. A removable loading element for a cargo ship, the removable loading element comprising:

a plurality of moveable plate elements configured to be moved to various locations of a hold of the cargo ship, the plurality of moveable plate elements forming a load surface that includes a plurality of receiving elements configured to be connected to securing elements, the receiving elements being distributed in a grid over the load surface, the load surface being configured to be at least one of a floor of a hold of the cargo ship and a raised load surface in the hold of the cargo ship.

16. A securing element comprising:

a main body having openings in two end portions, the openings being configured to be brought into engagement with a correspondingly shaped portion of a fixing element, wherein the fixing element is configured to be arranged in adjacent receiving means of a load surface of a cargo ship and configured to hold a container on the load surface, the securing element being adapted to prevent movement of the fixing means with respect to each other.

17. The ship according to claim 1 wherein a container is located on the load surface of at least one of the plurality of plate elements, wherein the fixing means is connected to the receiving means and to the container.

18. The ship according to claim 17 wherein a plurality of fixing means are connected to respective receiving means and to the container, wherein the fixing means hold the container in place.

19. A cargo ship comprising:

a hold; and a plurality of moveable plate elements located in the hold and configured to be moved between a plurality of locations in the hold, the plurality of moveable plates forming a load surface configured to receive and hold cargo, the load surface having a plurality of receiving elements that are configured to be connected to fixing structures that are configured to hold the cargo, the receiving element being distributed in a grid over the load surface of the plurality of moveable plate elements.

20. The ship according to claim 19 wherein the moveable plate elements are configured to be located on a floor surface of the hold and form a raised surface in the hold.

21. The ship according to claim 19 wherein the receiving elements are opening formed in the plurality of moveable plate elements, wherein the fixing structures are configured to be fixed into the openings of the moveable plate element.

* * * * *